United States Patent [19]

Kozicki

[11] 4,252,166

[45] Feb. 24, 1981

[54] LOG SPLITTER

[76] Inventor: Edward C. Kozicki, P.O. Box 3, R.D. 3, Stony Bank Rd., Glen Mills, Pa. 19342

[21] Appl. No.: 31,293

[22] Filed: Apr. 18, 1979

[51] Int. Cl.[3] ..... B27L 7/00

[52] U.S. Cl. ..... 144/194; 144/193 R

[58] Field of Search ..... 144/193 R, 194

[56] References Cited

U.S. PATENT DOCUMENTS 3,670,789 6/1972 Long ..... 144/194

FOREIGN PATENT DOCUMENTS 2652941 5/1978 Fed. Rep. of Germany ..... 144/194
2814249 7/1979 Fed. Rep. of Germany ..... 144/144
29303 2/1958 Finland ..... 144/193 R

*Primary Examiner*—W. Donald Bray
*Attorney, Agent, or Firm*—Frank H. Marks

[57] ABSTRACT

A device for splitting a log of wood or other material comprising a pair of similar augers of generally conical configuration disposed on spaced parallel axes, preferably to rotate in opposite directions. The augers are mounted as a convenient, manually portable unit in operative relation with a suitable power source, speed reduction unit and clutch. The invention is considered especially suitable for home use, though it may be embodied in a gang of any desired number of augers for rail splitting or other application, for home or industrial use. In some instances, certain advantages of my invention may be had with the tandem augers rotating in the same direction.

2 Claims, 3 Drawing Figures

LOG SPLITTER

My invention relates to log splitters, and has to do especially with devices of this nature intended primarily for home use, though not so restricted.

BACKGROUND

The most primitive and commonplace implement for splitting logs is, of course, a hand axe. Such a device requires considerable skill and practice as well as hard manual effort and is, even in skilled hands, wasteful of material lost as chips, involving also in unskilled hands an element of danger. Also, wedges driven by hand or power tools have been employed.

The prior art shows it to be old to employ a single auger, as illustrated in the following U.S. Pat. Nos.:

Weinberg—953,162
Merwin—1,319,656
Long—3,670,789
Thackery—3,993,113
Thackery—4,026,337
Thackery—4,027,709

BRIEF OUTLINE OF INVENTION

I have found that a single auger, while more satisfactory than a hand axe in splitting material such as wooden logs, is still not as effective as might be desired, due to various limitations. For example, a single auger presents some difficulty in presentation against a log surface, adjustment to an optimum angle of penetration, etc. Furthermore, the log must be restrained against uncontrolled movement.

My studies have shown that a plurality of similar augers, preferably two, mounted in tandem on parallel axes substantially normal to the major axis of the log to be split, is considerably more efficient as a splitting tool than might be expected from a mere multiplication of a single auger. With my invention a log may easily be split even by a most unskilled person lacking in great physical strength. No great care need be taken in presenting the tools at a particular angle to the log, and there is as a rule no tendency for the log to turn or otherwise move out of cutting position.

Furthermore, in employment of my invention, loss of material is reduced to a minimum, as in sawdust.

My invention is susceptible of embodiment in highly convenient, attractive form, eminently suitable for domestic use, for hand operation and maximum portability about domestic premises. It is also designed for ready knockdown, light-weight construction particularly suitable for mail order distribution.

Devices embodying my invention may be marketed as independent units or designed for convenient attachment to another mechanical device having its own power source, such as a power saw, sander, planer, etc.

Various other objects and advantages will appear to those skilled in the art as the description proceeds.

BRIEF DESCRIPTION OF DRAWINGS

Referring now to the drawings forming a part of this specification and illustrating a preferred embodiment of my invention.

DETAILED DESCRIPTION

Figure 1:
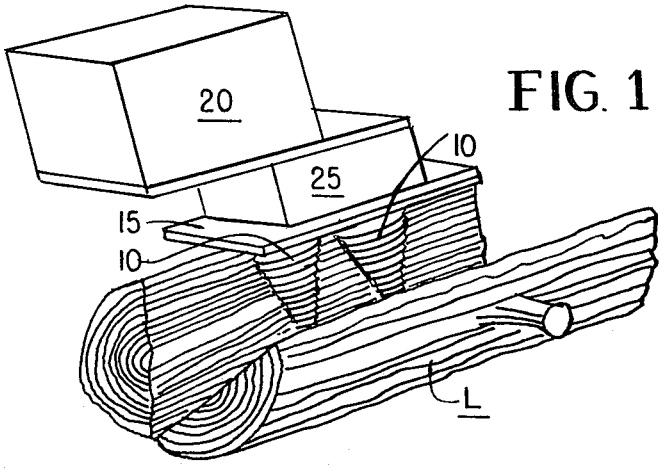
FIG. 1 is a perspective view of a splitting device embodying my invention in operation on a log of wood or the like, FIG. 2 is an elevational view of such a device.
Figure 2:
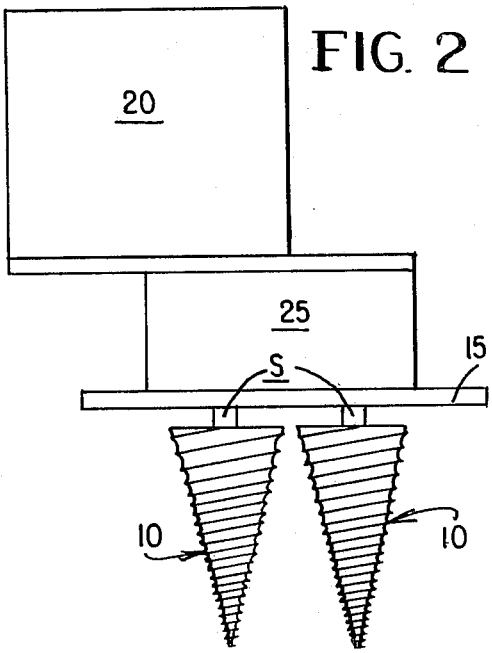
Figure 3:
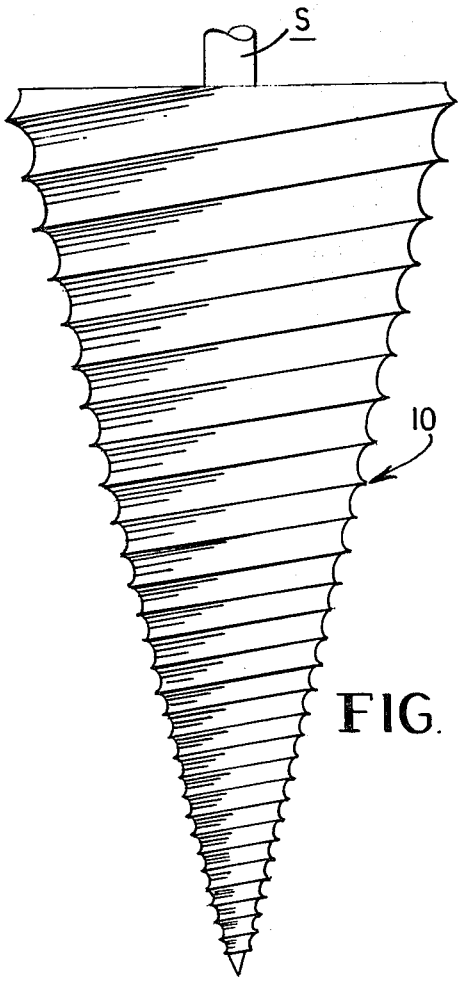
FIG. 3 is an enlarged elevational detail of an auger element of my invention, as seen in FIGS. 1 and 2.

It will be understood by those skilled in the art that certain elements of the combination constituting my invention are illustrated schematically in the drawings for the reason that standard, or any other suitable, mechanical means may be employed as such elements, various devices constituting such elements being well known. Hence, it is not considered necessary to burden this disclosure with details thereof.

Essentially, my invention contemplates a simple, compact, lightweight and readily portable unit comprising a plurality, preferably two, augers 10, 10 of generally conical form mounted on shafts S and carried by a base member 15 for rotation on spaced parallel axes in opposite directions. Whether the rotation of either auger is clockwise or counterclockwise is immaterial, as long as they rotate reversely to each other, in my preferred embodiment.

Carried on said base member 15 is a suitable power source 20, which might be a gasoline engine, electrical motor or other unit adapted to provide the necessary rotary power through a shaft (not seen). Usually, the rotary power obtainable from a standard unit obtainable on the market at moderate cost will deliver rotary power excessively high for my purposes; accordingly, it will usually be necessary to provide a suitable speed reduction unit 25 between the power source and augers 10, which may rotate at about 95 r.p.m., more or less. The power source may deliver, say, about 6,000 r.p.m. (The figures mentioned, of course, are purely exemplary, and not intended to be restrictive in any sense.)

In the same spirit, details of construction of the augers may vary within wide limits. For illustrative purposes only, it may be said that, for best results in a variety of applications of my invention, the augers may have a length, say, of about 8 to 12, preferably about 10, inches from base to apex, with a base diameter of, say, 3 to 5 inches, preferably about 3½".

The spiral thread or groove is preferably of circular formation. Regarding pitch of the groove, they are preferably about two inches in length at the tip portion, varying in radius from base to tip of the cone. As stated, the grooves are semi-circular in cross-section. The tip portion, about 2 inches in length, is preferably steel surfaced for high wear resistance, about 4 threads per inch. Thereabove, the diameter of the grooves increases gradually to about 0.5 inch.

The groove depth for the entire length of the cone may be from about 0.100 to 0.300 inch, preferably about 0.100 inch.

For good results, the auger speed of rotation may be from about 50 to 100 r.p.m.

Between the base portion and the steel tip portion the auger may be somewhat softer metal throughout or of the surface portion, such as aluminum. The hard tip portion may be of any suitable steel, though a specially hard alloy such as chrome steel is desirable.

Though, as described, best results are obtained when the augers are geared to rotate in reverse directions, my tests reveal that at least some of the advantages of my invention are obtained if they operate in the same direction, inasmuch as counter-torque is provided by piercing the material by the opposed augers -- a result not to be expected by those skilled in the art from a mere multiplication of the tools.

Operation of devices embodying my invention requires no special mechanical skill or training. They may be used safely and effectively by the average person. The rotating augers are positioned on the work surface (say a log) to be split, with only slight pressure. After slight penetration, say about ½ inch, the operation will proceed with substantially no manual pressure.

To permit backing out after possible sticking, suitable reversing means may be provided, such as a reversible motor. Or a suitable reversing device may be employed.

It is also contemplated that my invention may be employed for splitting longer lengths of material than the usual fireplace logs, as, for example, in producing fence rails, etc. For such an operation any desired number of augers may be mounted as a gang or single unit, say, three or more suitably spaced.

Conclusion

It will be seen that I have provided a new and useful tool representing a marked improvement over devices heretofore known for splitting logs and other materials.

As stated, my improved log splitter may be used independently or in conjunction with other power tools, as, for example, in combination with other power driven devices, such as a chain saw engine, etc.

Various other changes coming within the spirit of my invention may suggest themselves to those skilled in the art. Hence, I do not wish to be limited to the specific forms shown and described or uses mentioned except to the extent indicated by the appended claims.

I claim:

1. A log splitter with the capability of ready transport to a log adapted to be split, comprising means defining a light-weight manually portable unit including (a) a pair of conical augers arranged for rotation on parallel axes;

(b) support means for mounting said augers at the large end thereof including speed reduction means for imparting rotation to said augers; and (c) mechanical power means connected to said support means for transmitting rotary movement to said speed reduction means for conversion to work energy at the mounting point of said augers.

2. A device as in claim 1, wherein said speed reduction means defines means for controlling the speed and direction of said augers, whereby they may be rotated in the same or opposite directions.

* * * * *